United States Patent [19]

Gailitis

[11] 4,247,025

[45] Jan. 27, 1981

[54] AEROSOL VALVE HAVING LIQUID-PHASE/VAPOR-PHASE MIXER-HOMOGENIZER

[75] Inventor: Adolph R. Gailitis, Winchester, Mass.

[73] Assignee: Summit Packaging Systems, Inc., Manchester, N.H.

[21] Appl. No.: 64,086

[22] Filed: Aug. 6, 1979

[51] Int. Cl.[3] ..... B65D 83/14

[52] U.S. Cl. ..... 222/402.18; 222/402.24; 239/370; 239/404

[58] Field of Search ..... 239/369, 370, 337, 404; 222/402.1, 402.18, 402.24

[56] References Cited

U.S. PATENT DOCUMENTS

| | | | |
|---|---|---|---|
| 3,096,003 | 7/1963 | Nesin | 222/402.24 X |
| 3,653,553 | 4/1972 | Prussin et al. | 222/402.18 X |
| 4,061,252 | 12/1977 | Riccio | 222/402.18 X |

*Primary Examiner*—David A. Scherbel

*Attorney, Agent, or Firm*—Dallett Hoopes

[57] ABSTRACT

Aerosol valve is provided with a mixer-homogenizer plate disposed in the bottom of the valve cup. Vapor tap passing vapor into a central chamber between the valve inlet and the homogenizer plate creates a swirl in that chamber and subsequent passage of the mixture through arcuate slots effects high shear to enhance the mixing and promote homogenization in preparation for the ultimate atominzation by the actuator.

5 Claims, 3 Drawing Figures

AEROSOL VALVE HAVING LIQUID-PHASE/VAPOR-PHASE MIXER-HOMOGENIZER

BACKGROUND OF THE INVENTION

1. Field of the Invention

This invention relates to aerosol valves. More specifically, the invention relates to aerosol valves having special means to intermix the liquid phase with the gaseous or vapor phase in the aerosol container to promote extremely good atomization of the product.

2. Description of the Prior Art

There are, of course, in the prior art hundreds of showings of aerosol valves. A popular form of valve is one in which the tubular aerosol valve stem, through which the aerosol product passes, is itself the actuator for the valve. This form of valve generally includes an annular gasket surrounding the valve stem and a valve body or seat. These elements are disposed in a valve cup and are spring-pressed upwardly by a spring disposed between the bottom of the cup and the valve body. The bottom of the cup is formed with a tailpiece to which a dip tube is attached for moving liquid up out of the container.

Vapor pressure taps are common in aerosol valves and permit the combining of the vapor phase within the container with the liquid phase as the two move out of the container via the aerosol valve.

SUMMARY OF THE INVENTION

In the present invention with the valve structure described above, an additional part—a break-up plate or disc—is provided in the bottom of the valve cup cavity. This plate, which may be of plastic, supports the lower end of the valve spring and molded recesses are formed either on the bottom surface of the valve cup or on the lower surface of the plate to form a central cavity having tangential channels extending outwardly therefrom. Spaces are provided between the periphery of the plate and the valve cup sidewall. The valve vapor tap may be disposed spaced from the central cavity and a passage is provided from the vapor tap to the central cavity and directed to one side of the axis of the central cavity to produce a swirling effect. The result is that the liquid and vapor swirl about in the chamber and then move through the slots to result in further mixing and homogenizing.

BRIEF DESCRIPTION OF THE DRAWINGS

Further features and objects of the invention will be apparent from the following specification, including claims and the drawings, all of which disclose a non-limiting form of the invention. In the drawings:

DESCRIPTION OF THE PREFERRED EMBODIMENT

Figure 1:
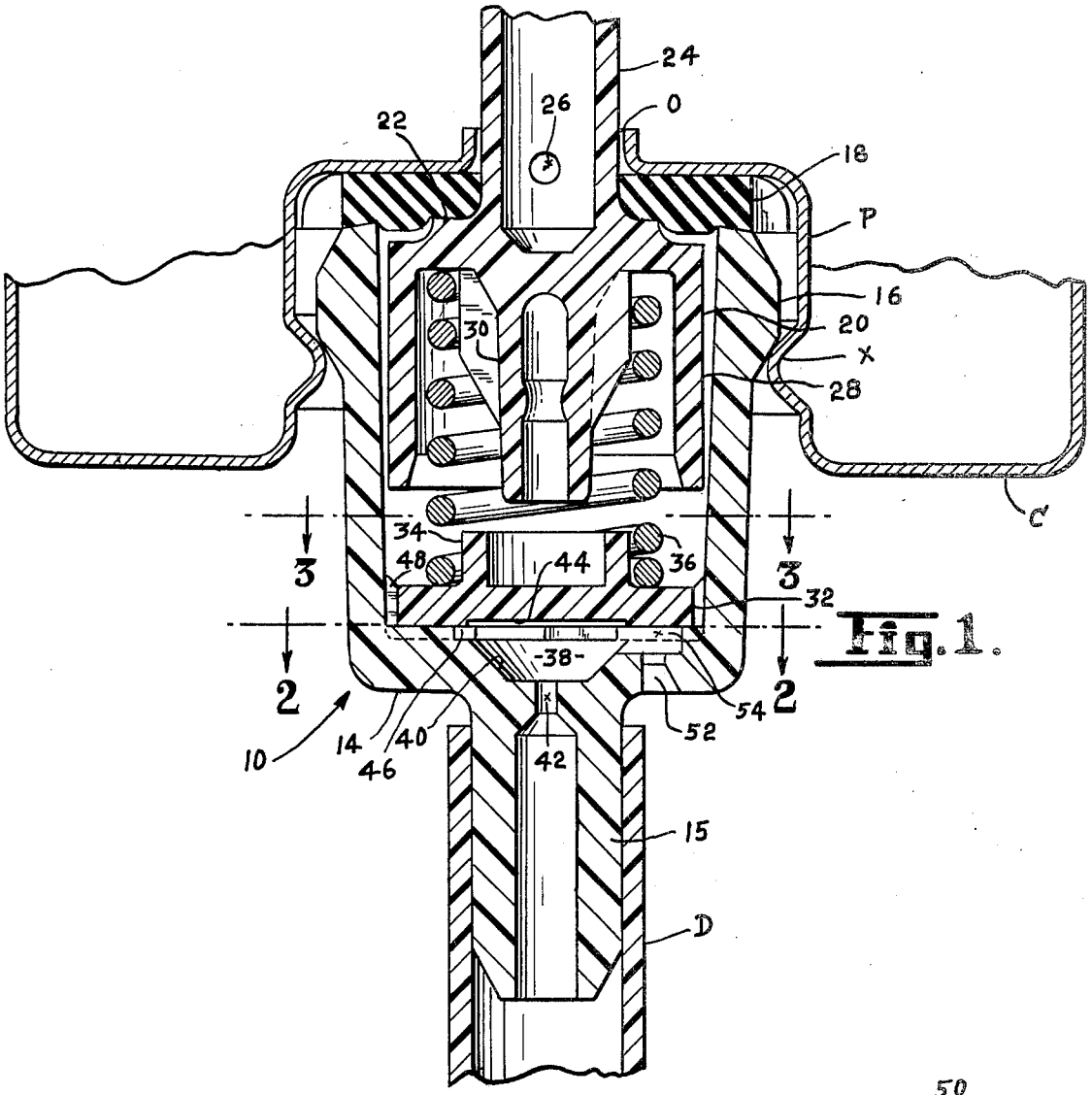
FIG. 1 is a sectional view of an aerosol valve embodying the invention installed at the upper end of an aerosol can.

Referring more specifically to the drawings, an aerosol valve embodying the invention is generally designated 10 in FIG. 1. It is crimped into the valve pedestal P of an aerosol container C. An opening O is provided at the center of the pedestal. The valve comprises a valve cup 14 having a conventional downward tailpiece 15 coupled to a dip tube D. A cup is formed with an enlargement 16 about the upper end thereof. An annular gasket 18 rests against the upper end of the cup 14 and the valve is held in place in the container by crimps X engaging firmly under the enlargement 16.

A body 20 is provided and includes a seat 22 and an upward tubular stem 24. Central of the seat, a discharge opening 26 is provided in the stem 24. A downward annular flange 28 is provided downward from the periphery of the seat 22. Central of the flange 28, the valve body is formed with a flanged spring guide 30.

A disc-like homogenizer plate 32 is provided and rests against the bottom wall of the cup 14. It is formed with an annular upward flange 34 spaced inward from its periphery. Completing the assembly is a spiral compression spring 36 which surrounds both the projection 30 and the flange 34 and urges the valve body 20 upward into seating position.

A configured chamber is formed between the bottom wall of the cup 14 and the undersurface of the homogenizer plate 32. The configurations may be formed on either surface or both surfaces as desired or necessary. In the embodiment shown, the configuration is formed in the bottom wall of the cup 14. The configuration includes a central chamber 38 defined in part by the bevelled wall 40 surrounding the valve inlet 42 in the bottom wall of the cup. The homogenizer 32 may be formed with a central upward circular recess 44.

Figure 2:
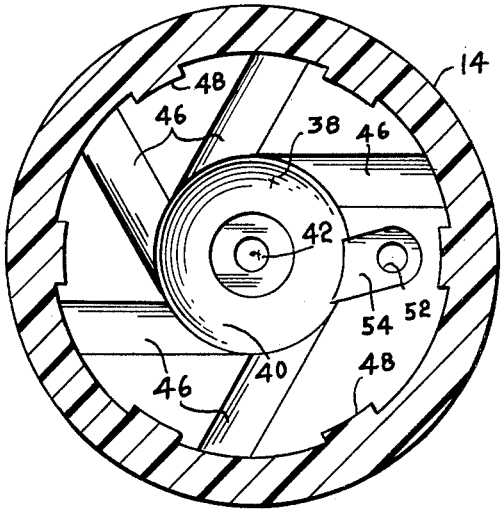
FIG. 2 is an enlarged sectional view taken on the line 2—2 of FIG. 1.
Figure 3:
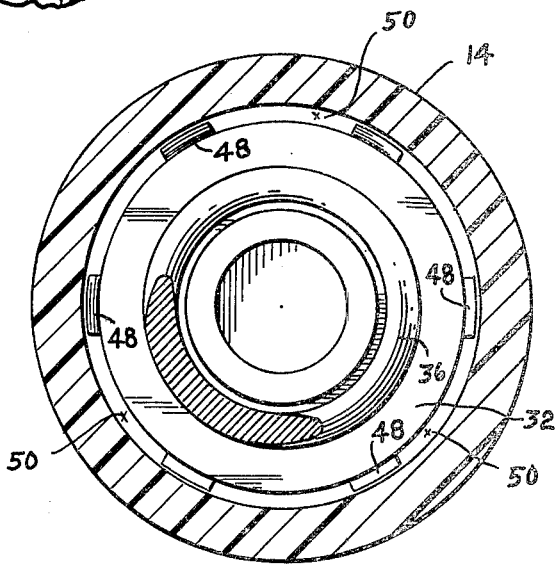
FIG. 3 is an enlarged sectional view taken on the line 3—3 of FIG. 2.

As shown best in FIG. 2, extending outward from the central chamber 38 are tangential spoke-like passages 46 which lead the product mixture to the periphery of the inside of the cup. Inward peripheral spacers 48 are formed in the cup wall and serve to hold the homogenizer plate central of the valve cup. This arrangement (FIG. 3) permits passages 50 between spacers 48. By carefully selecting the width of the spacers 48, the width of the passages 50 may also be selected to optimize the passageway of mixture.

Referring to FIG. 1, a vapor tap 52 is provided in the bottom wall of the cup 14 spaced from the inlet 42. The configured recess between the homogenizer plate and the bottom of the valve cup include a vapor passage 54 adapted to direct the vapor entering through the passage 52 to one side of the axis of the chamber 38 to thereby create a swirl within the chamber. It is in this swirl that the vapor and liquid mix to effect the optimum atomization of the product.

With the resulting structure, depressing of the valve stem 24 by the conventional actuator button (not shown) lowers the valve body 20 away from the gasket 18 and permits the opening 26 to clear the lower edge of the gasket to permit fluid in the valve cup chamber to move out through the valve discharge. This, of course, reduces pressure in the valve cup and causes the upward flow through the dip tube D and inlet 42 into the chamber 38. Reduction of pressure in the valve cup also causes flow of vapor phase through the tap 52 and passage 54 (FIG. 2) to induce a liquid/vapor swirl in chamber 38. This swirl causes a mixing and then outward flow through passages 46 of the mixture about the peripheral spaces 50 surrounding the homogenizer plate.

From thence, the mixture moves up about flange 28 and out the discharge opening 26.

It should be understood that the passage of the mixture through the slots 50 effect a homogenizing of the mixture to promote and enhance atomization. The passage of the liquid/vapor mixture through the slots effects a shearing of the mixture helping to accomplish a uniform particle break-up and subsequent atomination in the actuator. Atomization of the mixture is especially important where the mixture is aqueous and water is an ingredient in the product blend.

I claim:

1. In a valve for an aerosol container having an opening at the upper end thereof, the valve comprising an annular gasket disposed in sealing engagement about the stem, a valve cup crimped into the upper end of the container having a downward dip tube and a valve body in the cup and having a tubular stem extending up through the opening in the container and having a head seating on the gasket, the stem having an inlet opening and adapted to be depressed to lower the opening below the gasket to permit flow of product out the stem, and a spring disposed between the head and bottom of the cup; the improvement of a disc-like homogenizer plate disposed between the bottom of the opening and the floor of the cup, the plate being spaced from the sidewall of the cup to define slot means, the plate and floor forming between them an entrance swirl chamber with outward arms to the periphery of the plate, whereby the incoming product swirls in the chamber and then passes outward to the periphery of the plate and then through said slot means.

2. Structure as claimed in claim 1 wherein the bottom of the cup is apertured offset from the dip tube to permit vapor to enter the swirl chamber.

3. Structure as claimed in claim 2 wherein passage means connects the vapor to enter the swirl chamber to one side thereof.

4. Structure as claimed in claim 1 wherein spacer means spaces the plate to a central position in the valve cup.

5. Structure as claimed in claim 1 wherein the dip tube inlet to the swirl chamber is chamfered.

* * * * *